US010566756B2

(12) United States Patent
Imgrüt et al.

(10) Patent No.: US 10,566,756 B2
(45) Date of Patent: Feb. 18, 2020

(54) CRIMPING TOOL EXCHANGE DEVICE AND METHOD FOR EXCHANGING A FIRST CRIMPING TOOL ARRANGED AT A PROCESS POSITION IN A CRIMPING PRESS WITH ANOTHER SECOND CRIMPING TOOL

(71) Applicant: Komax Holding AG, Dierikon (CH)

(72) Inventors: Peter Imgrüt, Cham (CH); Beat Wicki, Adligenswil (CH)

(73) Assignee: KOMAX HOLDING AG, Dierikon (CH)

( * ) Notice: Subject to any disclaimer, the term of this patent is extended or adjusted under 35 U.S.C. 154(b) by 299 days.

(21) Appl. No.: 15/497,273

(22) Filed: Apr. 26, 2017

(65) Prior Publication Data

US 2017/0317459 A1 Nov. 2, 2017

(30) Foreign Application Priority Data

Apr. 27, 2016 (EP) ..... 16167205

(51) Int. Cl.
*H01R 43/055* (2006.01)
*H01R 43/048* (2006.01)

(52) U.S. Cl.
CPC ..... *H01R 43/048* (2013.01); *H01R 43/055* (2013.01)

(58) Field of Classification Search
CPC ..... H01R 43/048; H01R 43/055
USPC ..... 72/416
See application file for complete search history.

(56) References Cited

U.S. PATENT DOCUMENTS 3,911,712 A * 10/1975 Wustinger ..... H01R 43/0421 72/324
5,706,570 A * 1/1998 Inoue ..... H01R 43/048 29/566.2
2001/0023531 A1 9/2001 Hasegawa
2014/0150260 A1* 6/2014 Fischer ..... H01R 43/055 29/862
2017/0317459 A1* 11/2017 Imgrut ..... H01R 43/055

FOREIGN PATENT DOCUMENTS

EP 1341269 A1 9/2003
EP 1667289 A1 6/2006
EP 1764882 A1 3/2007
(Continued)

*Primary Examiner* — David B Jones
(74) *Attorney, Agent, or Firm* — William J. Clemens; Shumaker, Loop & Kendrick, LLP

(57) ABSTRACT

A crimping tool exchange device for exchanging crimping tools in a process position in a cable crimp contact crimping press has at least two exchange spots that each retain a crimping tool. When the exchange spots are in a first exchange position, a first tool is displaced from the process position to a first exchange spot along a first direction of movement, the exchange spots are linearly moved from the first exchange position into a second exchange position wherein the first tool and a second tool located on a second exchange spot move in a second direction of movement that differs from the first direction of movement, and in the second exchange position the second tool is displaced from the second exchange spot into the process position in a third direction of movement that is opposite to the first direction of movement.

18 Claims, 11 Drawing Sheets

(56) References Cited

FOREIGN PATENT DOCUMENTS

| | | | |
|---|---|---|---|
| EP | 1764883 | A1 | 3/2007 |
| EP | 1764884 | A1 | 3/2007 |
| EP | 3024099 | A1 | 5/2016 |
| JP | S6199288 | A | 10/1984 |
| JP | H059715 | U | 2/1993 |
| JP | H0544321 | U | 6/1993 |
| JP | H08111275 | A | 4/1996 |
| JP | H1012349 | A | 1/1998 |
| JP | H11192521 | A | 7/1999 |
| JP | 3014928 | B2 | 2/2000 |
| JP | 2000138087 | A | 5/2000 |
| JP | 2000140960 | A | 5/2000 |
| JP | 2004111264 | A | 4/2004 |
| JP | 2017208328 | A | 11/2017 |

* cited by examiner

CRIMPING TOOL EXCHANGE DEVICE AND METHOD FOR EXCHANGING A FIRST CRIMPING TOOL ARRANGED AT A PROCESS POSITION IN A CRIMPING PRESS WITH ANOTHER SECOND CRIMPING TOOL

FIELD

The invention relates to a crimping tool exchange device and to a method for exchanging a first crimping tool arranged at a process position in a crimping press with another second crimping tool.

BACKGROUND

FIG. 11 shows a crimping press 10 according to the prior art. A crimping tool 50 is arranged in the crimping press 10. The crimping tool 50 comprises a mushroom-shaped retaining dowel 13 on the upper end of the crimping tool 50, which is arranged in a movable upper tool holder 11 of the crimping press 10. In addition, the crimping press 10 comprises an immovable lower tool holder 19.

Different crimping tools are required for different crimp contacts or different purposes, respectively, so that the crimping tool must be exchanged with another crimping tool in the crimping press.

As a rule, the manual exchange of the crimping tool with another crimping tool is prone to errors and is slow. As a rule, it is additionally not ensured that the new crimping tool is arranged at the same position in the crimping press as the exchanged crimping tool (which was previously arranged in the crimping press). After an exchange of the crimping tool, the position of the crimping tool or of the crimp contact, respectively, or of the cable, respectively, must thus typically be aligned anew. As a rule, this is time-consuming. The operation of the crimping press is interrupted during the alignment. This typically leads to high costs.

SUMMARY

The invention is based on an object of specifying a device or a method, respectively, by means of which a first crimping tool, which is installed in a crimping press, can be exchanged with a second crimping tool in a technically simple manner.

The object is solved in particular by means of a crimping tool exchange device for exchanging a first crimping tool arranged in a process position in a crimping press for establishing a crimp connection for connecting a conductor end of a cable to a crimp contact with a second crimping tool, wherein the crimping tool exchange device has at least two exchange spots for retaining a crimping tool each, wherein the exchange spots can be arranged in a first exchange position in such a way that the first crimping tool can be displaced, in particular linearly, from the process position to a first one of the exchange spots along a first direction of movement, the exchange spots can be linearly moved from the first exchange position into a second exchange position in such a way that the first crimping tool located on the first one of the exchange spots and a second crimping tool located on a second one of the exchange spots move in a second direction of movement, which differs from the first direction of movement, and the exchange spots can be arranged in the second exchange position in such a way that the second crimping tool can be displaced from the second one of the exchange spots into the process position in a third direction of movement, which runs opposite to the first direction of movement.

One advantage of this is that, as a rule, the first crimping tool can be exchanged simply and quickly with the second crimping tool, which is not identical to the first crimping tool. In addition, it is advantageous that the crimping tool exchange device typically takes up little space or volume, respectively, and requires little space during the exchange process. It is furthermore ensured that the second crimping tool is arranged at the same position as the first crimping tool, namely the process position, in the crimping press. A re-alignment of the crimping tool or of the crimp contact, respectively, or of the cable, respectively, is thus typically not required. As a rule, this saves time. In the case of existing common crimping presses, the crimping tool exchange device can furthermore be retrofitted.

The crimping tool exchange device can comprise a guide device, in particular a T-shaped guide track, for guiding and retaining a retaining dowel of the first crimping tool and for guiding and retaining a second retaining dowel of the second crimping tool during the displacement of the first crimping tool and/or of the second crimping tool. As a rule, the crimping tool is or the crimping tools are, respectively, guided in a particularly secure manner during the exchange or displacement, respectively. In addition, it is an advantage that the retaining dowel of the crimping tool can typically be guided towards the upper tool holder of a common crimping press at the same level. The exchange is thus further simplified. Normally, the crimping tool can additionally be brought into the process position in an even more secure manner. The retaining dowel can be a mushroom-shaped retaining dowel on the upper end of the crimping tool.

The at least two exchange spots can encompass at least two exchange tables for retaining a crimping tool each in such a way that the first one of the exchange spots is arranged on the first exchange table and the second one of the exchange spots is arranged on the second exchange table. The respective crimping tools are thus typically retained in a particularly secure manner during the exchange. This improves the secure execution of the exchange process.

The crimping tool exchange device can comprise a first locking device for releasably locking the first crimping tool at the first exchange spot and/or a second locking device for releasably locking the second crimping tool at the second exchange spot. One advantage of this is that the crimping tool or the crimping tools, respectively, can be held particularly securely during the exchange. A slipping of the crimping tool relative to the corresponding exchange spot during the movement of the exchange spots from the first exchange position into the second exchange position is typically also prevented in a particularly reliable manner.

The crimping tool exchange device can have at least one moving device for moving the first crimping tool and/or for moving the second crimping tool and/or for moving the exchange spots and/or for locking the first crimping tool at the first exchange spot and/or the second crimping tool at the second exchange spot. The exchange process can thus typically be carried out in an automated manner. A manual engagement is not required during the exchange process. As a rule, the exchange process can thus be carried out particularly quickly and securely. It is a further advantage that the movements or the displacement, respectively, of the crimping tools are typically carried out particularly accurately. This ensures even more that the second crimping tool is arranged at exactly the same process position in the crimping press, at which the first crimping tool was previously arranged in the crimping tool.

In one embodiment, the crimping tool exchange device is embodied in such a way that the respective crimping tool can be exchanged together with the crimp contacts, which belong to the respective crimping tool. An advantage of this is that it is not only the crimping tool, which can be exchanged particularly simply and quickly from a technical aspect, but also the crimp contacts. The crimping press can thus typically be used in a particularly flexible manner. As a rule, this additionally saves time and thus costs, because the operation of the crimping press is only interrupted very briefly.

The crimping tool can in each case be capable of being moved together with an adapter plate, to which the respective crimping tool is fastened in a releasable immovable manner, and the adapter plate can be capable of being releasably fixed in such a way that the crimping tool, which is releasably fastened to the adapter plate, is arranged in the process position. One advantage of this is that the crimping tool can typically be fastened to the adapter plate at different positions. This serves to align the crimping tool with respect to the crimping press or the crimp contact, respectively. Immovably releasably fastened means that the crimping tool cannot be moved or shifted, respectively, with respect to the adapter plate, if the crimping tool is fastened to the adapter plate, while the fastening can simultaneously be released, however, so that after releasing the fastening, the crimping tool can be shifted with respect to the adapter plate (in order to subsequently fasten the crimping tool to the adapter plate again in an immovable manner, possibly in another position). The adapter plate can always be fixed in the same position with respect to the crimping press, so that the crimping tool fixed to the adapter plate is fixed at the process position.

The crimping tool exchange device can comprise a support plate, on which the first exchange table rest in part in the first exchange position and/or the second exchange table in the second exchange position, and on which the crimping tool is arranged in the process position. One advantage of this is that, as a rule, the displacement of the crimping tools can be carried out even more securely and quicker. The exchange tables are in each case supported in a particularly secure manner, so that substantially no vibrations or other undesired movements of the exchange tables occur.

The support plate can have guide elements and a stop part for aligning the crimping tool in the process position. One advantage of this is that it is ensured that the second crimping tool is typically arranged at exactly the same process position, at which the first crimping tool was previously arranged. As a rule, the displacement of the crimping tools is additionally even more secure. The method can thus be carried out particularly quickly and accurately.

The object is in particular also solved by means of a method for exchanging a first crimping tool arranged at a process position in a crimping press with another second crimping tool, wherein the crimping press is embodied for establishing a crimp connection by means of the crimping tool, which is arranged at the process position and which connects a conductor end of a cable to a crimp contact, wherein the method comprises the following steps: providing the second crimping tool at a second exchange spot of at least two exchange spots of a crimping tool exchange device, while the exchange spots are located in a first exchange position, displacing the first crimping tool along a first direction of movement from the process position to a first exchange spot of the crimping tool exchange device, linearly moving the exchange spots comprising the first crimping tool and the second crimping tool from the first exchange position into a second exchange position in a second direction of movement, which differs from the first direction of movement, and displacing the second crimping tool from the second exchange spot of the crimping tool exchange device into the process position along a third direction of movement, which is opposite to the first direction of movement, while the exchange spots are located in the second exchange position.

One advantage of this method is that the first crimping tool is typically exchanged with the second crimping tool, which is not identical to the first crimping tool, in a technically simple and quick manner. In addition, it is advantageous that, as a rule, the crimping tool exchange device takes up little space or volume, respectively, and requires little space during the exchange process. Typically, it is furthermore ensured that the second crimping tool is arranged at the same position as the first crimping tool, namely the process position, in the crimping press. As a rule, a re-alignment of the crimping tool or of the crimp contact, respectively, or of the cable, respectively, is thus not required. This saves time. As a rule, the crimping tool exchange device can moreover be retrofitted in the case of existing common crimping presses.

The displacement movements of the first crimping tool and/or of the second crimping tool and/or of the exchange spots can be carried out by at least one moving device. The exchange process is thus carried out in an automated manner. A manual engagement is typically not required during the exchange process. The exchange process can thus be carried out particularly quickly and securely. It is a further advantage that, as a rule, the movements or the displacement, respectively, of the crimping tools are carried out particularly accurately. This ensures even more that the second crimping tool is arranged at exactly the same process position in the crimping press, at which the first crimping tool was previously arranged in the crimping tool.

In one embodiment, the first crimping tool is fastened to a first adapter plate and the first crimping tool is displaced together with the first adapter plate and the second crimping tool is fastened to a second adapter plate and the second crimping tool is displaced together with the second adapter plate. One advantage of this is that the crimping tool can be fastened at different positions on the adapter plate. This serves to align the crimping tool with respect to the crimping press or the crimp contact, respectively. The adapter plate can always be fixed in the same position with respect to the crimping press, so that the crimping tool fixed to the adapter plate is fixed at the process position.

The respective crimping tool can be moved with respectively corresponding crimp contacts for connecting to the conductor end of the cable. It is an advantage of this method that it is not only the crimping tool, which can be exchanged particularly simply and quickly from a technical aspect, but also the crimp contacts. As a rule, the crimping press can thus be used in a particularly flexible manner. Typically, this additionally saves time and thus costs, because the operation of the crimping press is only interrupted very briefly.

The first crimping tool can be locked at the first exchange spot by means of a first locking device and/or the second crimping tool can be locked at the second exchange spot by means of a second locking device. One advantage of this is that, as a rule, the crimping tool or the crimping tools, respectively, can be held particularly securely during the exchange. A slipping of the crimping tool relative to the corresponding exchange spot during the movement of the exchange spots from the first exchange position into the second exchange position is typically also prevented in a particularly reliable manner.

During the displacement, a retaining dowel of the first crimping tool and/or a retaining dowel of the second crimping tool can be guided in a guide device, in particular a T-shaped guide track. The crimping tool is or the crimping tools are thus guided respectively, in a particularly secure manner during the exchange or displacement, respectively. In addition, it is an advantage that, as a rule, the retaining dowel of the crimping tool can be guided towards the upper tool holder of a common crimping press at the same level. The exchange is thus further simplified. In addition, the crimping tool can be brought into the process position in an even more secure manner. The retaining dowel can be a mushroom-shaped retaining dowel on the upper end of the crimping tool.

It is pointed out that some of the possible features and advantages of the invention herein are described with respect to different embodiments. A person of skill in the art recognizes that the features can be combined, adapted or exchanged in a suitable manner, in order to get to further embodiments of the invention.

DESCRIPTION OF THE DRAWINGS

Exemplary embodiments of the invention will be described below with reference to the enclosed drawings, wherein neither the drawings nor the description are to be interpreted as limiting the invention.

The figures are only schematic and are not true to scale. The same reference numerals identify the same features or features having the same effect in the figures.

DETAILED DESCRIPTION

Figure 1:
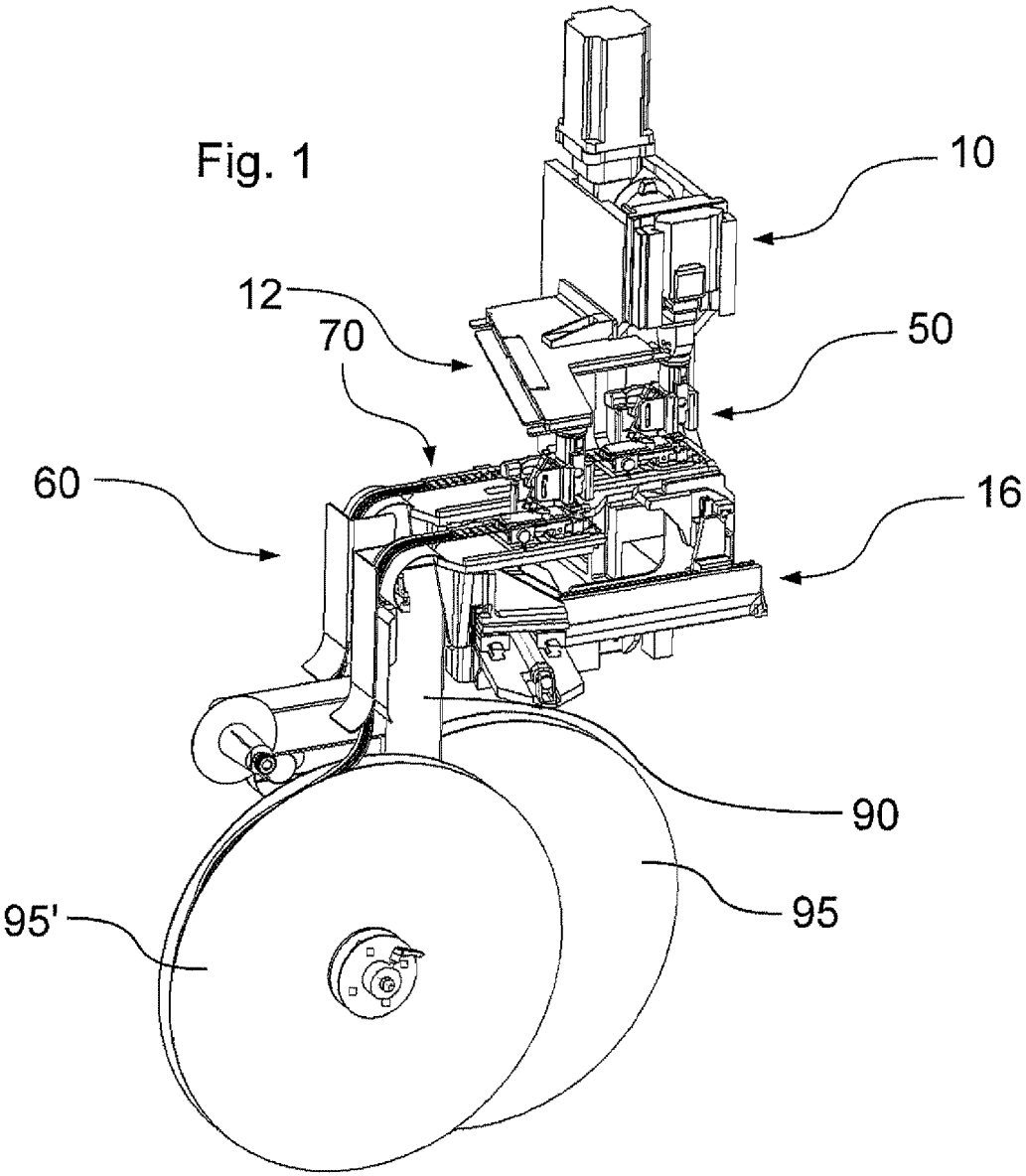
FIG. 1 shows a perspective of a first embodiment according to the invention of the crimping tool exchange device comprising crimping tools and crimping press.
Figure 2:
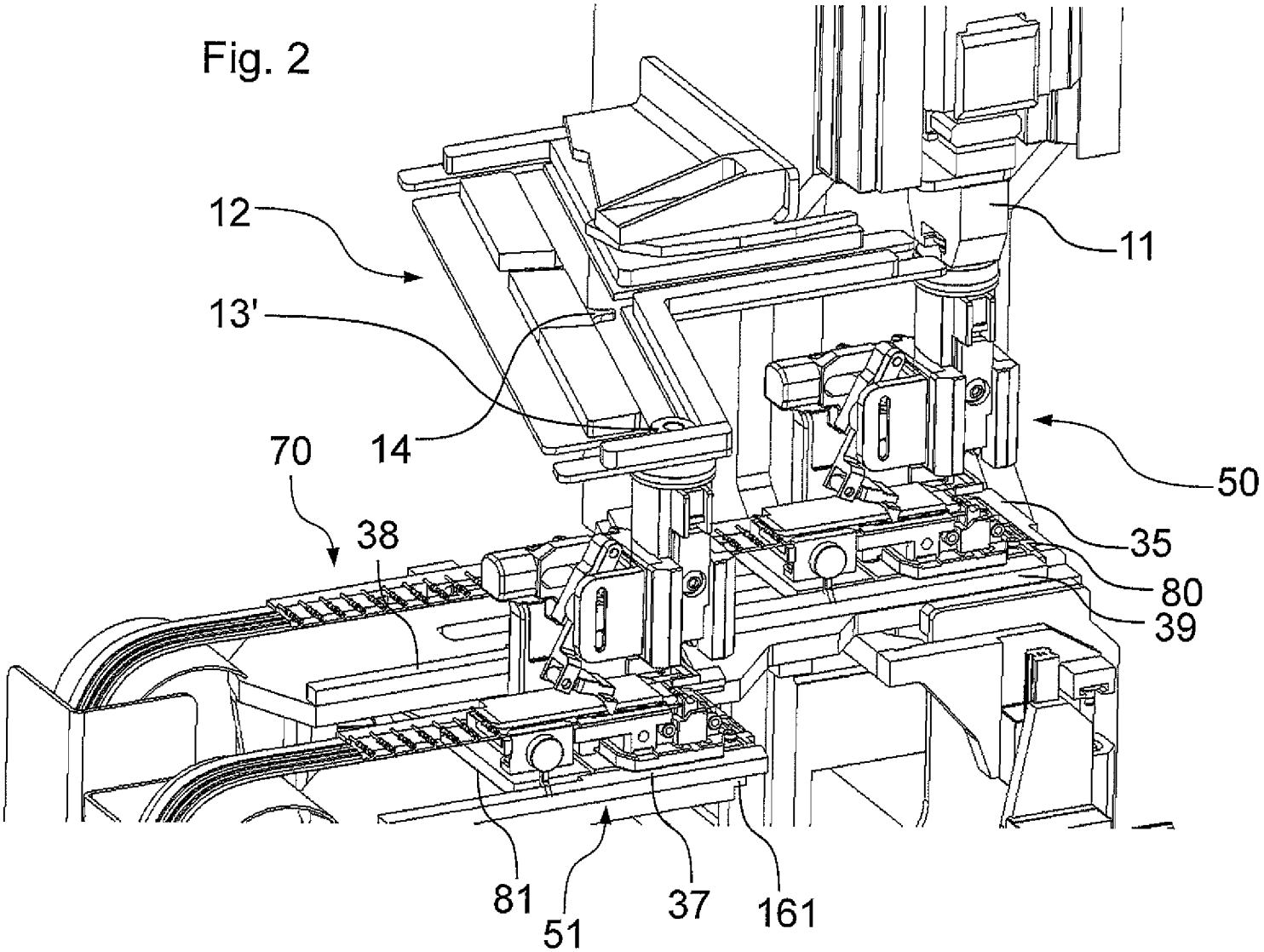
FIG. 2 shows a perspective detailed view of the crimping tool exchange device from FIG. 1.
Figure 3:
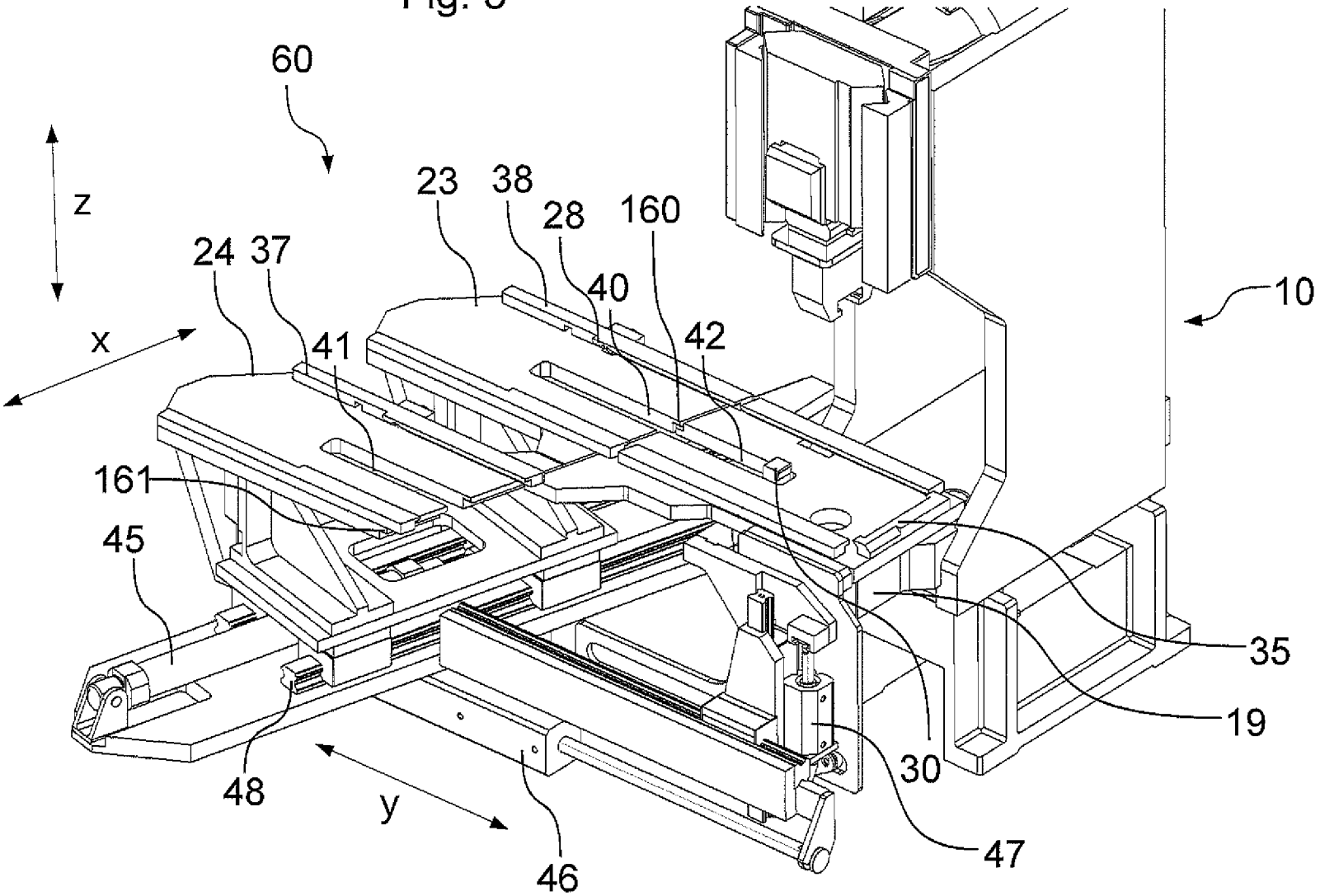
FIG. 3 shows a perspective detailed view of the crimping tool exchange device from FIG. 1 without crimping tools and without guide track.
Figure 4:
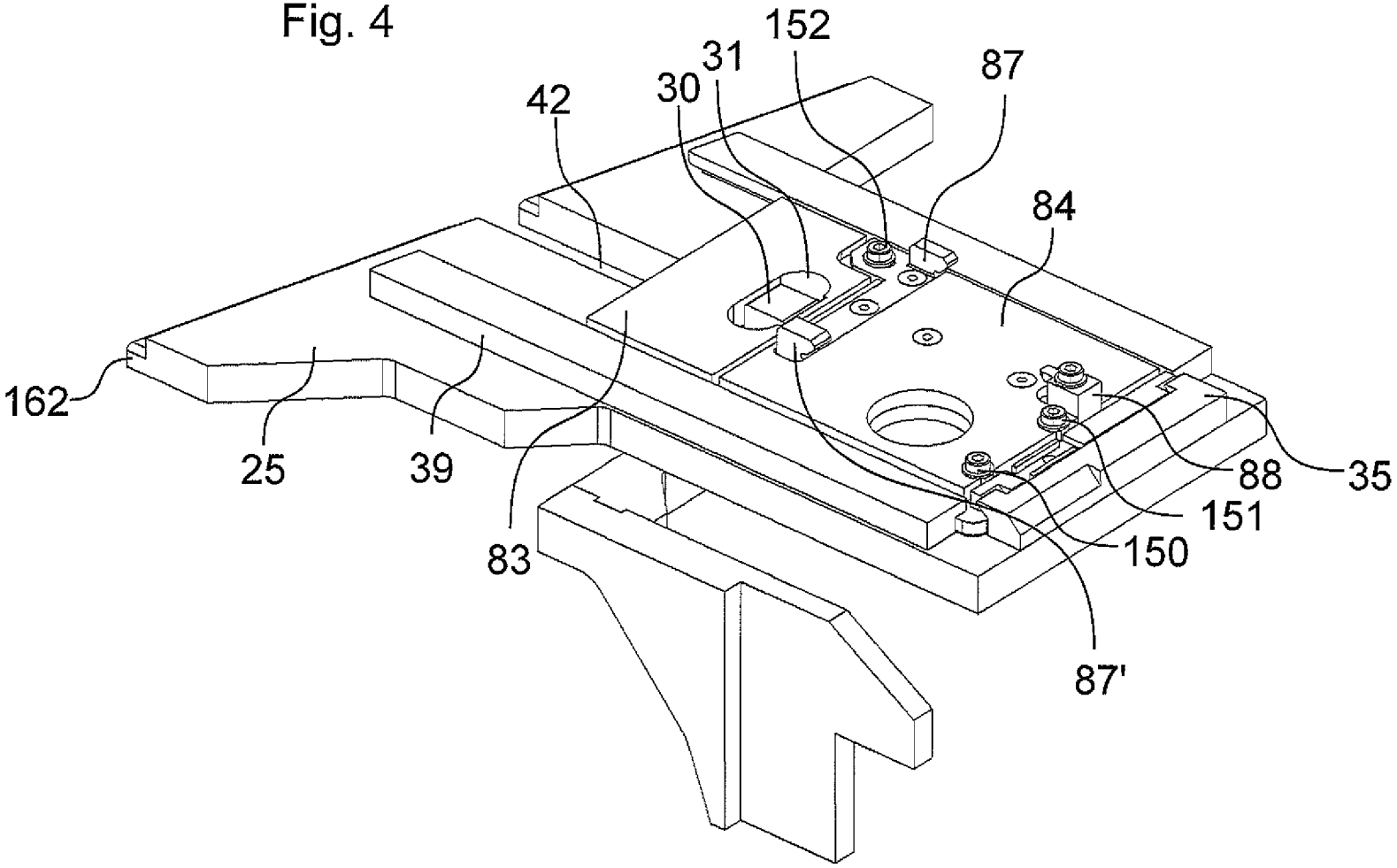
FIG. 4 shows a perspective view of a support plate of the crimping tool exchange device from FIGS. 1-3.
Figure 5:
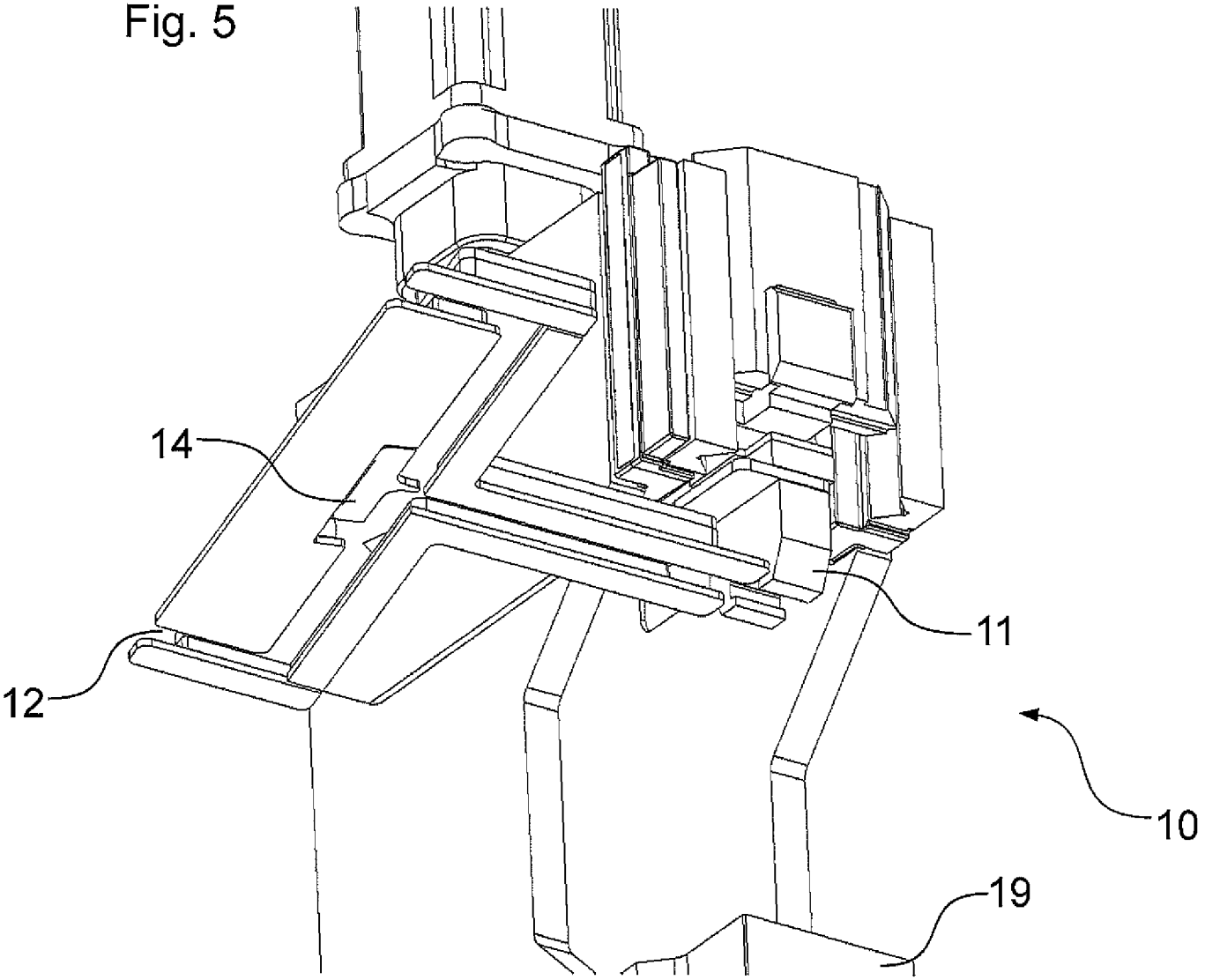
FIG. 5 shows a further perspective detailed view of the crimping tool exchange device from FIG. 1.

FIG. 1 shows a perspective view of a first embodiment according to the invention of a crimping tool exchange device 60 comprising crimping tools 50, 51 (FIG. 2) and the crimping press 10. FIG. 2 shows a perspective detailed view of the crimping tool exchange device 60 from FIG. 1. FIG. 3 shows a perspective view of the crimping tool exchange device 60 from FIG. 1 without crimping tools and without guide track. FIG. 4 shows a perspective view of a support plate 25 of the crimping tool exchange device 60 from FIGS. 1-3. And FIG. 5 shows a further perspective detailed view of the crimping tool exchange device 60 from FIG. 1.

The crimping tool exchange device 60 serves to exchange a first crimping tool 50 with a second crimping tool 51, wherein the second crimping tool 51 is not identical to the first crimping tool 50. The crimping tool 50 is installed in the crimping press 10. The crimping press 10 establishes a crimp connection between a conductor end of a cable and a crimp contact 70 by means of the crimping tool 50, 51. The crimp contacts 70 can be different to one another. Different crimping tools can be used for different crimp contacts 70.

The crimping press 10 comprises the upper tool holder 11, in which a retaining dowel 13, 13', which is located at the upper end of the crimping tool 50, 51, is received. The retaining dowel 13, 13' can be embodied in a mushroom-shaped manner.

The crimping tool exchange device 60 is arranged at the common crimping press 10 (by means of attachment parts 16 and the guide device) or is fastened thereto, respectively. The crimping tool exchange device 60 can thus also be used with previously known crimping presses or previously known crimping presses can be retrofitted, respectively.

The crimping tool 50, 51 comprises an anvil. The crimping contact 70, which is to be fastened to the conductor end of a cable, is aligned via the anvil, is deformed by means of the die of the crimping tool 50, 51, and is fastened to the conductor end of the cable in this manner. This position, in which the crimping tool 50, 51 can carry out the crimping process, is called a process position.

The crimping tool exchange device 60 comprises at least two exchange spots. It is also possible for the crimping tool exchange device 60 to have three, four or more exchange spots. The exchange spots in each case serve to retain the crimping tool 50, 51. The exchange spots can be exchange tables 23, 24, as it is illustrated in the figures.

The crimping tool 50, 51 is assembled or immovably releasably fastened, respectively, on an adapter plate 80, 81. The adapter plate 80, 81 is moved together with the crimping tool 50, 51 or vice versa, respectively. By means of the immovable fastening of the adapter plate 80, 81 on the support plate 25, the crimping tool 50, 51 is also immovably fastened to the support plate 25. The crimping tool 50, 51 can be fastened in different positions on the adapter plate 80, 81, because the adapter plate 80, 81 is embodied in two parts. The adapter plate 80, 81 comprises an adapter plate frame 83 and a receiving plate 84 arranged thereon so as to be capable of being shifted (and to be fixed with screws 150, 151, 152). The receiving plate 84 can be shifted, because the screws 150, 151, 152 are arranged in through holes or slots of the receiving plate 84, which are dimensioned in a correspondingly larger manner. The receiving plate 84 is connected to the adapter plate 80, 81 or the adapter plate frame 83, respectively, or is fastened thereto, respectively, by means of the three screws 150, 151, 152.

Three hook-shaped elements are fastened to the receiving plate 84: two fixed hook-shaped elements or hooks 87, 87', respectively, and one movable hook-shaped element or hook 88, respectively. The hooks 87, 87', 88 serve to clamp the crimping tool.

The support plate 25 has two guide rails 39, which can be aligned so as to be aligned with guide rails 37 of the first exchange table 23 or so as to be aligned with guide rails 38 of the second exchange table 24. In addition, the support plate 25 has a stop part 35. When the adapter plate 80, 81 is shifted or displaced, respectively, in the guide rails 39 with the crimping tool 50, 51 fastened thereto until the adapter plate 80, 81 strikes or rests against the stop part 35, respectively, the crimping tool 50, 51 is located in the process position in the crimping press 10.

The two exchange tables 23, 24 are rigidly connected to one another in such a way that the moving of one of the exchange tables 23, 24 simultaneously moves the other exchange table 23, 24 as well. Each of the exchange tables 23, 24 has the guide rails 37, 38, which run parallel to one another and comprise an outer edge of the adapter plate 80, 81.

The two exchange tables 23, 24 are embodied so as to be constructed in the same way. The two exchange tables 23, 24 can be moved by means of a moving device. For this purpose, the crimping tool exchange device 60 has a first pneumatic cylinder 45. The two exchange tables 23, 24 can be displaced in an x direction (in FIG. 3 to the right and rearwards and to the left and forwards) so as to be guided by two rails 48 by means of the first pneumatic cylinder 45.

In the first exchange position and the second exchange position, the exchange tables 23, 24 are in each case arranged in such a way that the first crimping tool 50 or the second crimping tool 51, respectively, can be shifted or displaced, respectively, from the process position to the first exchange table 23 or from the second exchange table 24 into the process position, respectively, on the support plate 25 without change in height. The support plate 25 bears on the lower tool holder 19 of the crimping press 10. The first exchange table 23 or the upper surface of the first exchange table 23, respectively, and the second exchange table 24 or the upper surface of the second exchange table 24, respectively, are attached to or arranged at, respectively, the same height or at the same level, respectively, as the support plate 25 or the upper surface of the support plate 25, respectively. The crimping tool 50, 51 can thus be displaced or moved, respectively, from the process position on the support plate 25 to the first exchange table 23 or the second exchange table 24, respectively, or vice versa, without raising or lowering the crimping tool 50, 51.

In FIG. 3, the exchange spots are arranged in the first exchange position. The two exchange tables 23, 24 in each case have a recess 40, 41, which is arranged in the center between the respective two guide rails 37, 38. The support plate 24 also has a recess 42, which is arranged in the center between the guide rails 39 of the support plate 25. An actuator 30, which engages with a guide opening 31 of the adapter plate 80, 81, can be moved in the recesses 40, 41, 42. When the actuator 30 is located in the guide opening 31 of the adapter plate 80, 81, the adapter plate 80, 81 and thus also the crimping tool exchange device 60 fastened to the adapter plate 80, 81 move, when the actuator 30 is moved. In the first exchange position, the recess 42 of the support plate 25 is aligned with the recess 40 of the first exchange table 23. In the second exchange position, the recess 42 of the support plate 25 is aligned with the recess 41 of the second exchange table 24. The actuator 30 pushes the respective adapter plate 80, 81 against the stop part 35 and thus fixes the adapter plate 80, 81 in such a way that the crimping tool 50, 51 is located in the process position.

The actuator 30 can be moved in a y direction (in FIG. 3 to the left and rearwards and to the right and forwards) by means of a second pneumatic cylinder 46. In addition, the crimping tool exchange device 60 has a third pneumatic cylinder 47, by means of which the actuator 30 can be moved in a z direction. The z direction stands vertically on the plane, which is spanned by the x direction and the y direction. The actuator 30 can be inserted into the guide opening 31 of the adapter plate 80, 81 from bottom to top and can be removed again from top to bottom by means of the movement of the third pneumatic cylinder 47.

In the first exchange position, a part of the first exchange table 23, namely a first stepped protrusion 160, bears on the support plate 25. In the second exchange position, a part of the second exchange table 24, namely a second stepped protrusion 161, bears on the support plate 25. The support plate 25 has a stepped protrusion 162, which is embodied complementary to the respective protrusions 160, 161 of the first exchange table 23 or of the second exchange table 24, respectively. The two protrusions 160, 161 of the two exchange tables 23, 24 are embodied so as to be constructed in the same way. The support plate 25 bears on the lower tool holder 19.

The crimping tool exchange device 60 comprises a guide device for retaining and guiding the retaining dowel 13 of the first crimping tool 50 and the retaining dowel 13' of the second crimping tool 51. The guide device comprises a guide track 12, which is embodied so as to be substantially T-shaped. On the two opposite ends of the T-shaped guide track 12, the retaining dowel 13, 13' of the crimping tool 50, 51 can be inserted into or guided out of, respectively, the guide track. A movable slotted guide piece 14 is arranged at the crossing of the T-shaped guide track 12. The slotted guide piece 14 is in each case moved in the x direction when the crimping tool 50, 51 is moved to the process position and prevents the retaining dowel 13, 13' from falling out of the guide track 12 at the crossing of the guide track 12. The guide track 12 is arranged at such a height or such a level (above the support plate 25), respectively, that the guide track 12 is at the same level with the holder of the upper tool holder 11 of the crimping press 10. In response to moving or displacing, respectively, the crimping tool 50, 51, the retaining dowel 13, 13' thus moves from the guide track 12 into the upper tool holder 11 and vice versa without a change in height. The shape of the guide track 12 allows the crimping tools 50, 51 the same movements, which are carried out by the movement of the exchange tables 23, 24, the displacement of the first crimping tool 50 from the process position to the first exchange table 23 in the first exchange position, and the displacement of the second crimping tool 51 from the second exchange table 24 in the second exchange position. The movements of the crimping tool 50, 51 and thus of the retaining dowel 13, 13' of the crimping tool 50, 51, are carried out by the active movement of the actuator 30 by the moving device.

The crimping tools 50, 51 each have a contact roller holder 90, which feeds the crimp contacts 70 from a crimp contract roller 95, 95'. The crimp contacts 70 or the crimp contact roller 95, 95', respectively, are always moved together uniformly with the respective crimping tool 50, 51.

Each of the two exchange tables 23, 24 has a ball pressure piece 28, which serves for releasably fastening the respective crimping tool 50, 51 to the respective exchange table 23, 24. The ball pressure piece 28 in each case engages with the adapter plate 80, 81 from the side and thus fixes it.

Figure 6:
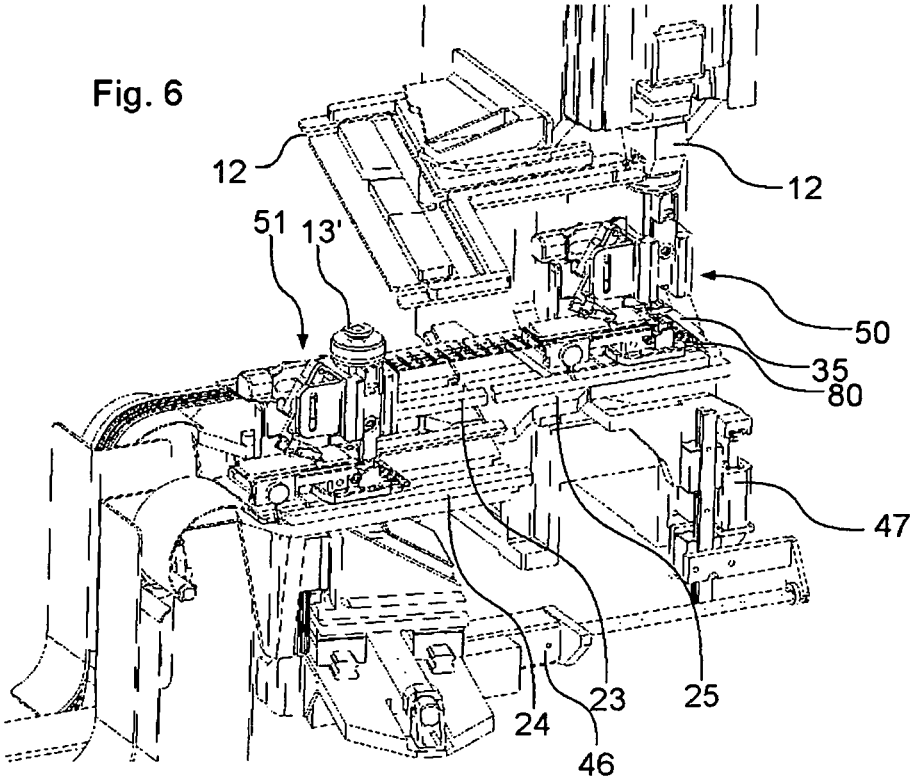
FIGS. 6-10 show perspective views of the individual steps of exchanging the first crimping tool with a second crimping tool by means of the crimping tool exchange device from FIG. 1.

FIGS. 6-10 show perspective views of the individual steps of the exchanging of the first crimping tool 50 with the second crimping tool 51 by means of the crimping tool exchange device 60 from FIG. 1. In FIG. 6, the first crimping tool 50 is in the process position, i.e. in the position, in which the crimping press 10 can connected a first crimp contact 70 to a conductor end of the cable by means of the crimping tool 50, 51. The first crimping tool 50 is fixed to the first adapter plate 80. The adapter plate 80, in turn, is pushed against the stop part 35 by the actuator 30.

The second crimping tool 51 comprising a second crimp contact 70, which can differ from the first crimp contact 70, will now be or is, respectively, provided on the second exchange table 24. The second crimping tool 51 is arranged on the second adapter plate 81. With respect to the second adapter plate 81, the second crimping tool 51 is preferably arranged at the same position as the first crimping tool 50 with respect to the first adapter plate 80. The second adapter plate 81 is inserted into the guide rails 38 of the second exchange table 24.

The second crimping tool 51 is now shifted to the right and the movable part of the second crimping tool 51 (the upper part of the second crimping tool 51 comprising the retaining dowel 13') is raised, in order to push it into the guide track 12. The second crimping tool 51 on the second adapter plate 81 is shifted so far to the right in FIG. 6 until the ball pressure piece 28 fixes the second adapter plate 81. The contact strip comprising the crimp contacts 70 is then inserted into the second crimping tool 51.

Figure 7:
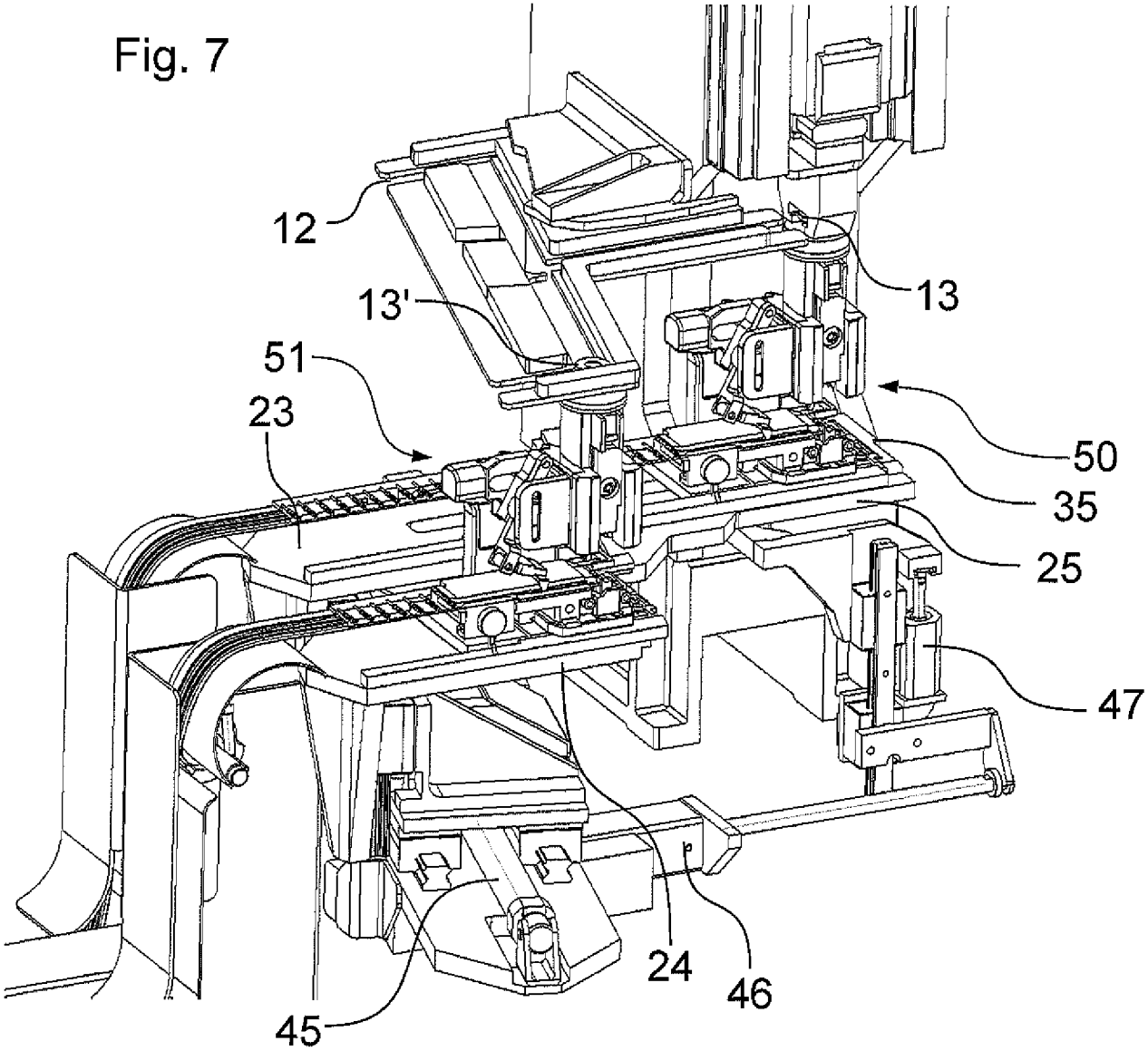

The state after these steps is illustrated in FIG. 7.

The exchange process is now triggered in that the moving device is activated. The actuator 30 moves from the position (all the way on the right in FIG. 7), in which the actuator 30 pushes the first adapter plate 80 against the stop part 35, to the left (i.e. away from the stop part 35) and thus pushes or displaces, respectively, the first adapter plate 80 comprising the first crimping tool 50 from the support plate 25 to the first exchange table 23. The actuator 30 hereby moves to the left as far as possible in FIG. 7. This takes place until the ball pressure piece 28 of the first exchange table 23 fixes the first adapter plate 80 and thus the first crimping tool 50 on the first exchange table 23.

Figure 8:
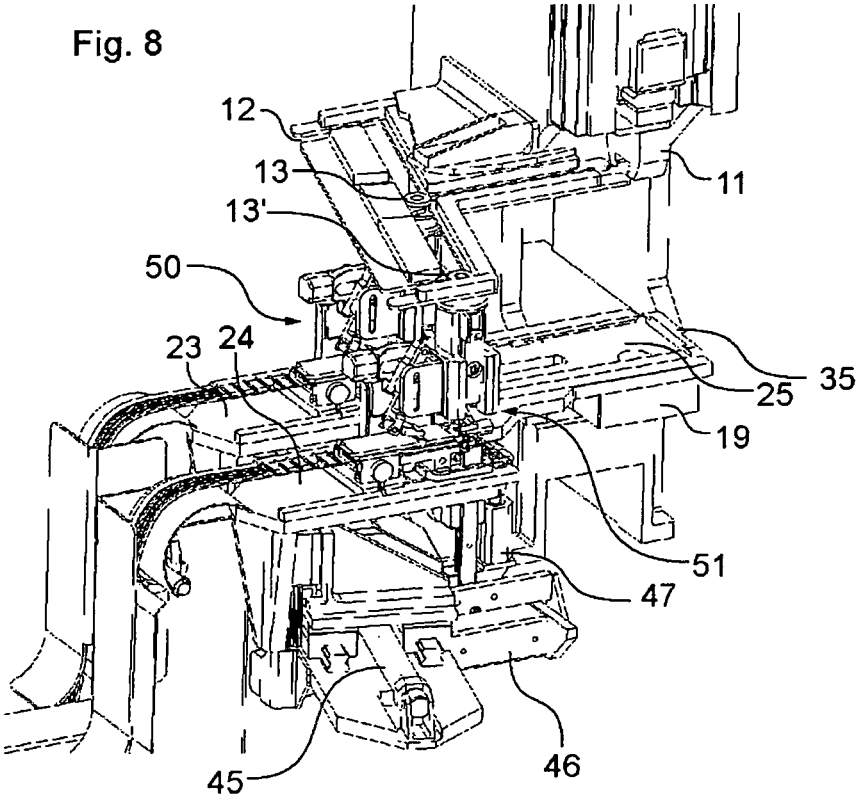

The state after this step or these steps, respectively, is shown in FIG. 8.

The actuator 30 now moves downwards. The actuator 30 thus leaves the guide opening 31 of the first adapter plate 80.

The exchange tables 23, 24, i.e. the exchange spots, are then moved rearwards in the x direction. This takes place until the guide rails 38 of the second exchange table 24 are aligned with the guide rails 39 of the support plate 25. The second exchange table 24 comprising the second crimping tool 51 is now at the location, where the first exchange table 23 comprising the crimping tool 50 was located prior to this. The slotted guide in the guide track 12 is thereby pushed rearwards through the retaining dowel 13' of the second crimping tool 51. The dowel pin of the second crimping tool 51 is now located at the crossing of the guide track 12.

Figure 9:
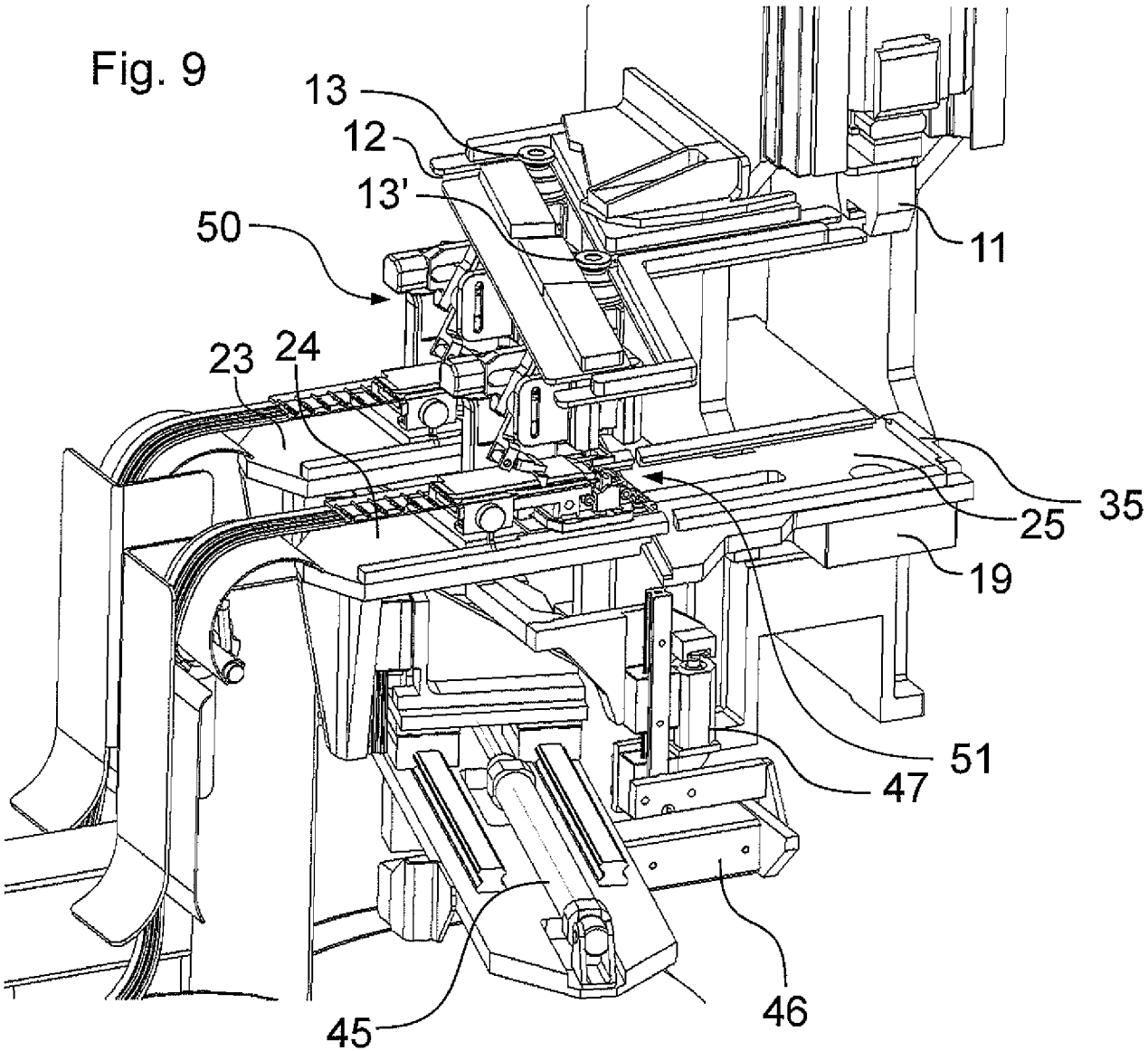

The state after this step is shown in FIG. 9.

The actuator 30 now moves upwards again and is inserted into the guide opening 31 of the second adapter plate 81, to which the second crimping tool 51 is fixed. The actuator 30 subsequently moves to the right and displaces the second crimping tool 51 along the guide rails 38, 39 from the second exchange table 24 to the support plate 25 (in the y direction). The actuator 30 thus moves so far to the right and displaces the second adapter plate 81 comprising the second crimping tool 51 until the second adapter plate 81 pushes against the stop part 35. The second crimping tool 51 is now in the process position. In response to the displacement, the retaining dowel 13' of the second crimping tool 51 reaches into the upper tool holder 11 of the crimping press 10.

Figure 10:
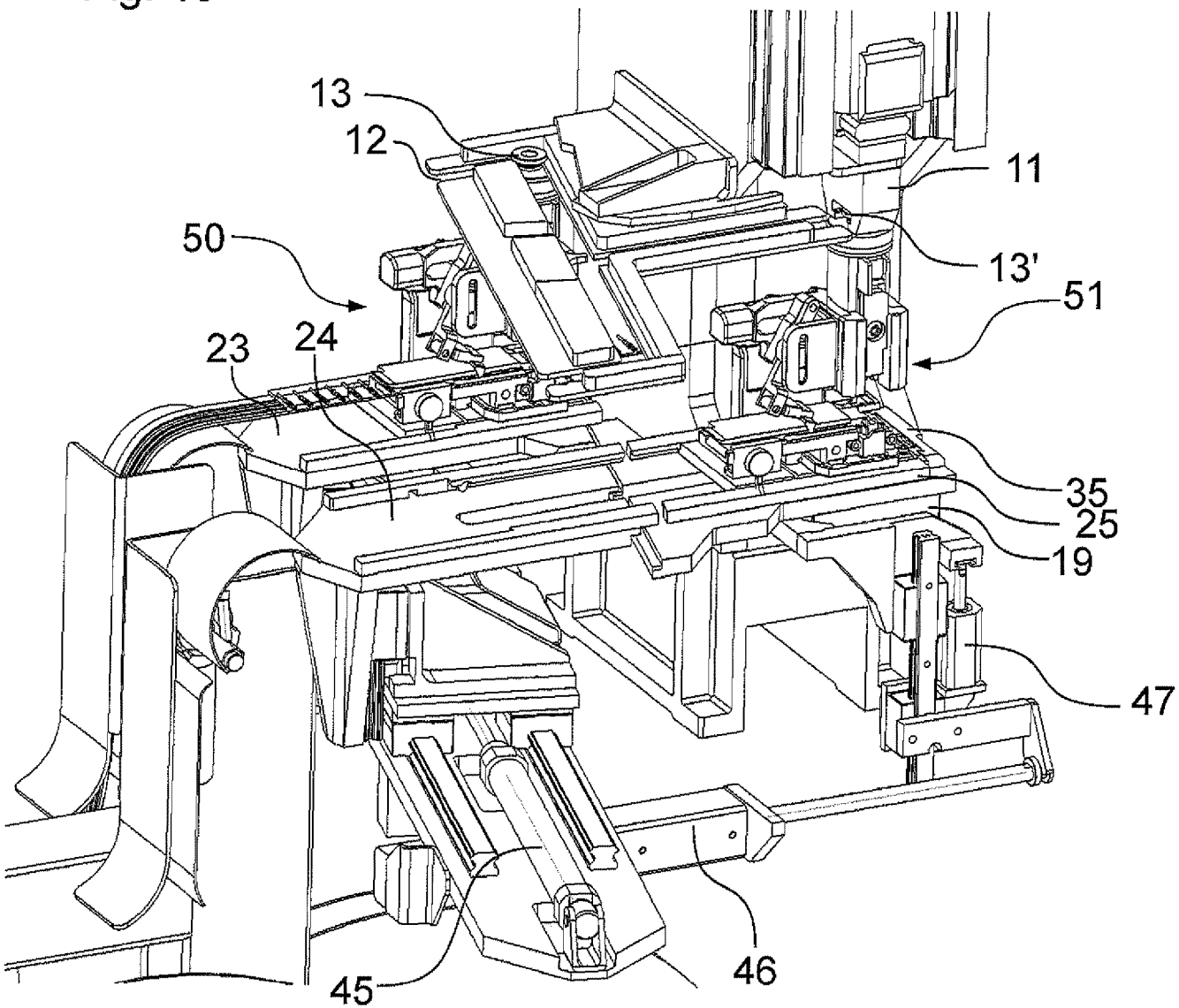
Figure 11:
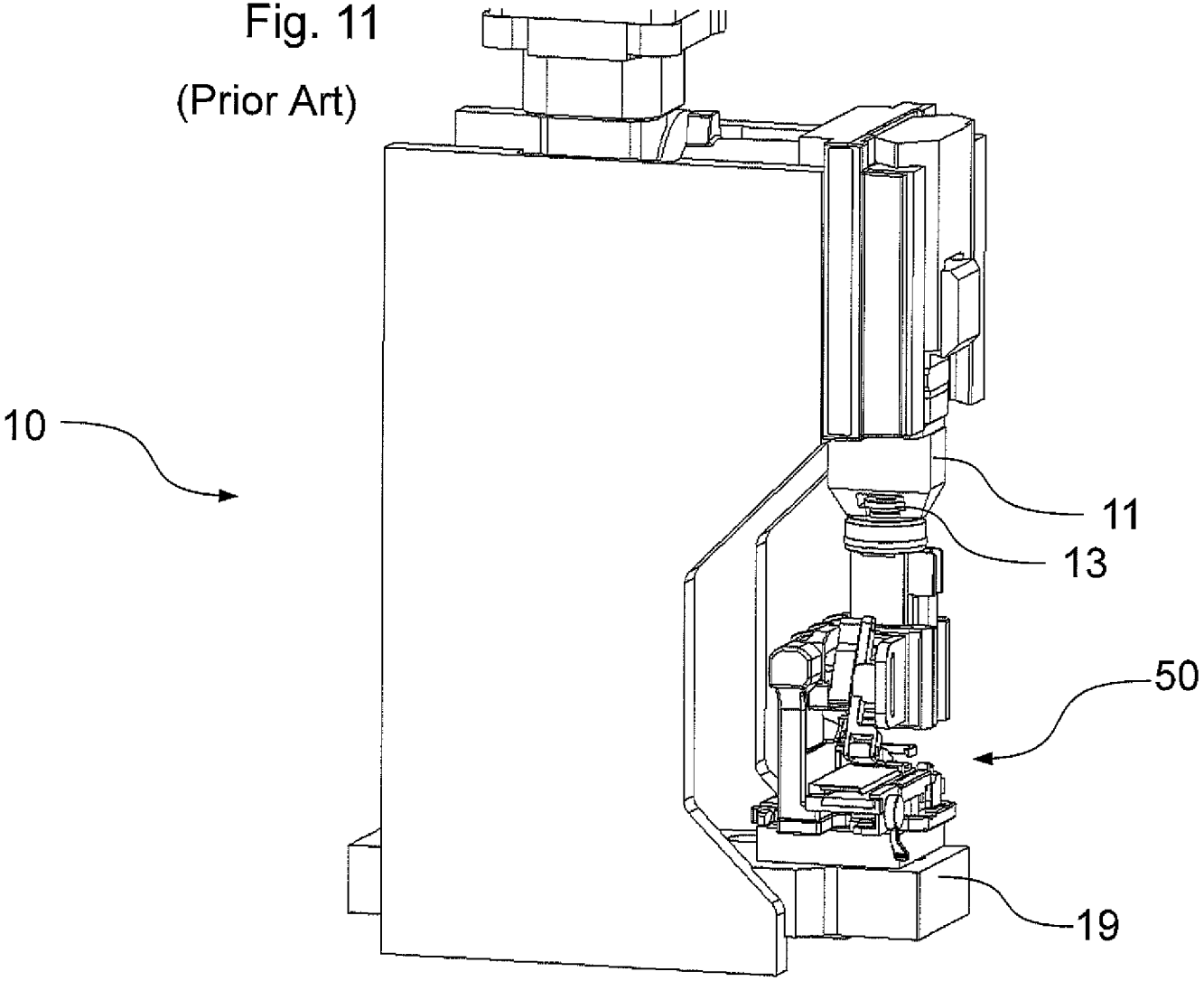
Fig. 11 (Prior Art)
FIG. 11 shows a crimping press comprising a crimping tool according to the prior art.

The state (final state) after this step is shown in FIG. 10.

The first crimping tool 50 can now remain on the first exchange table 23 or can be removed from the first exchange table 23 (after releasing the first locking device). Another crimping tool can subsequently be placed onto the first exchange table 23. The exchange process can now be carried out again. The second crimping tool 51 is hereby displaced to the second exchange table again, the exchange tables 23, 24 are moved forwards and the first crimping tool 50 or the another crimping tool is subsequently displaced from the first exchange table 23 to the support plate 25 into the process position.

It is also possible that from the state shown in FIG. 10, the second crimping tool 51 is removed from the second exchange table 24 and the exchange tables 23, 24 are moved forwards. Another (or the same) crimping tool can now be placed onto the first exchange table 23, so that the state as in FIG. 6 is reestablished.

The crimping tools 50, 51 are moved by means of respective corresponding crimp contacts 70 and crimp contact rollers 95, 95'.

It is possible that the first crimping tool 50 or the second crimping tool 51, respectively, is in each case fixedly or immovably, respectively, connected to the receiving plate 84 and that the receiving plate 84 is in each case connected to the adapter plate 80, 81 by means of the screws 150, 151, 152.

In summary, it is important to point out that terms, such as "having", "comprising", etc. do not exclude other elements or steps and that a term, such as "one" do not exclude a plurality.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A crimping tool exchange device for exchanging a first crimping tool, the first crimping tool being arranged in a process position in a crimping press for establishing a crimp connection for connecting a conductor end of a cable to a crimp contact, with a second crimping tool, the crimping tool exchange device comprising:

at least two exchange spots each for retaining one of the first crimping tool and the second crimping tool, the exchange spots being movably mounted on the crimping tool exchange device and being movable between a first exchange position and a second exchange position;

wherein when the crimping tool exchange device is attached to the crimping press and the exchange spots are arranged in the first exchange position, the first crimping tool can be displaced from the process position to a first one of the exchange spots along a first direction of movement;

then when the exchange spots are moved from the first exchange position into a second exchange position, the first crimping tool located on the first exchange spot and the second crimping tool located on a second one of the exchange spots move in a second direction of movement that differs from the first direction of movement;

then when the exchange spots are arranged in the second exchange position, the second crimping tool can be displaced from the second exchange spot into the process position in a third direction of movement that runs opposite to the first direction of movement;

wherein the first crimping tool includes a first retaining dowel and the second crimping tool includes a second retaining dowel and the crimping tool exchange device has a guide device mounted thereon, the guide device guiding and retaining the first retaining dowel and guiding and retaining the second retaining dowel during the displacement of the first crimping tool and the second crimping tool respectively; and wherein the guide device includes a T-shaped guide track for guiding and retaining the first and second retaining dowels.

2. The crimping tool exchange device according to claim 1 wherein the first exchange spot includes a first exchange table for retaining the first crimping tool and the second exchange spot includes a second exchange table for retaining the second crimping tool.

3. The crimping tool exchange device according to claim 2 including a support plate on which the first exchange table rests in part in the first exchange position and the second exchange table rests in part in the second exchange position, and on which the first and second crimping tools are arranged in the process position.

4. The crimping tool exchange device according to claim 3 wherein the support plate has guide elements and a stop part for aligning the first and second crimping tools in the process position.

5. The crimping tool exchange device according to claim 1 including at least one of the first exchange spot includes a first locking device for releasably locking the first crimping tool at the first exchange spot and the second exchange spot includes a second locking device for releasably locking the second crimping tool at the second exchange spot.

6. The crimping tool exchange device according to claim 1 including at least one moving device, the at least one moving device being connected to the exchange spots for moving the exchange spots between the first exchange position and the second exchange position, or the at least one moving device engaging and moving the first crimping tool, thereby locking the first crimping tool at the first exchange spot, and engaging and moving the second crimping tool, thereby locking the second crimping tool at the second exchange spot.

7. The crimping tool exchange device according to claim 1 wherein the first crimping tool and the second crimping tool are each coupled to an associated contact roller holder feeding crimp contacts that move with the respective first and second crimping tools.

8. The crimping tool exchange device according to claim 1 wherein the first and second crimping tools are fastened in a releasable immovable manner to an associated adapter plate and the adapter plates locating the first and second crimping tools in the process position and alternatively on the first and second exchange spots respectively.

9. A method for exchanging a first crimping tool arranged at a process position in a crimping press with a second crimping tool, wherein the crimping press establishes crimp connections with the first and second crimping tools when arranged at the process position to connect a conductor end of a cable to a crimp contact, the method comprising the steps of:

providing the second crimping tool at a second exchange spot of at least two exchange spots of a crimping tool exchange device while the exchange spots are located in a first exchange position;

displacing the first crimping tool along a first direction of movement from the process position to a first exchange spot of the crimping tool exchange device;

linearly moving the exchange spots with the first crimping tool and the second crimping tool from the first exchange position into a second exchange position in a second direction of movement that differs from the first direction of movement; and displacing the second crimping tool from the second exchange spot of the crimping tool exchange device into the process position along a third direction of movement that is opposite to the first direction of movement while the exchange spots are located in the second exchange position.

10. The method according to claim 9 wherein the displacement movements of at least one of the first crimping tool, the second crimping tool and the exchange spots are carried out by at least one moving device.

11. The method according to claim 9 wherein the first crimping tool is fastened to a first adapter plate and the first crimping tool is displaced together with the first adapter plate, and wherein the second crimping tool is fastened to a second adapter plate and the second crimping tool is displaced together with the second adapter plate.

12. The method according to claim 9 including moving each of the first and second crimping tools with associated crimp contacts for connecting to the conductor end of the cable.

13. The method according to claim 9 wherein at least one the first crimping tool is locked at the first exchange spot by a first locking device and the second crimping tool is locked at the second exchange spot by a second locking device.

14. The method according to claim 9 wherein a retaining dowel of at least one of the first crimping tool and the second crimping tool is guided in a guide device during the displacement.

15. The method according to claim 14 wherein the guide device includes a T-shaped guide track for guiding the retaining dowel.

16. A crimping tool exchange device for exchanging a first crimping tool, the first crimping tool being arranged in a process position in a crimping press for establishing a crimp connection for connecting a conductor end of a cable to a crimp contact, with a second crimping tool, the crimping tool exchange device comprising:

at least two exchange spots each for retaining one of the first crimping tool and the second crimping tool, the exchange spots being movably mounted on the crimping tool exchange device and being movable between a first exchange position and a second exchange position;

wherein when the crimping tool exchange device is attached to the crimping press and the exchange spots are arranged in the first exchange position, the first crimping tool can be displaced from the process position to a first one of the exchange spots along a first direction of movement;

then when the exchange spots are moved from the first exchange position into a second exchange position, the first crimping tool located on the first exchange spot and the second crimping tool located on a second one of the exchange spots move in a second direction of movement that differs from the first direction of movement;

then when the exchange spots are arranged in the second exchange position, the second crimping tool can be displaced from the second exchange spot into the process position in a third direction of movement that runs opposite to the first direction of movement;

wherein the first exchange spot includes a first exchange table for retaining the first crimping tool and the second exchange spot includes a second exchange table for retaining the second crimping tool; and including a support plate on which the first exchange table rests in part in the first exchange position and the second exchange table rests in part in the second exchange position, and on which the first and second crimping tools are arranged in the process position.

17. The crimping tool exchange device according to claim 16 wherein the support plate has guide elements and a stop part for aligning the first and second crimping tools in the process position.

18. A crimping tool exchange device for exchanging a first crimping tool, the first crimping tool being arranged in a process position in a crimping press for establishing a crimp connection for connecting a conductor end of a cable to a crimp contact, with a second crimping tool, the crimping tool exchange device comprising:

at least two exchange spots each for retaining one of the first crimping tool and the second crimping tool, the exchange spots being movably mounted on the crimping tool exchange device and being movable between a first exchange position and a second exchange position;

wherein when the crimping tool exchange device is attached to the crimping press and the exchange spots are arranged in the first exchange position, the first crimping tool can be displaced from the process position to a first one of the exchange spots along a first direction of movement;

then when the exchange spots are moved from the first exchange position into a second exchange position, the first crimping tool located on the first exchange spot and the second crimping tool located on a second one of the exchange spots move in a second direction of movement that differs from the first direction of movement;

then when the exchange spots are arranged in the second exchange position, the second crimping tool can be displaced from the second exchange spot into the process position in a third direction of movement that runs opposite to the first direction of movement; and wherein the first crimping tool and the second crimping tool are each coupled to an associated contact roller holder feeding crimp contacts that move with the respective first and second crimping tools.

* * * * *